US006854167B2

(12) United States Patent
Goineau et al.

(10) Patent No.: US 6,854,167 B2
(45) Date of Patent: Feb. 15, 2005

(54) TREATMENT OF FILAMENT YARNS TO PROVIDE SPUN-LIKE CHARACTERISTICS AND YARNS AND FABRICS PRODUCED THEREBY

(75) Inventors: Andre M. Goineau, Spartanburg, SC (US); David A. Lawrence, Greenville, SC (US); Jimmy B. Henson, Pacolet, SC (US); Renee G. Booths, Taylors, SC (US); Curtis Brian Williamson, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 148 days.

(21) Appl. No.: 10/315,409

(22) Filed: Dec. 9, 2002

(65) Prior Publication Data

US 2004/0107553 A1 Jun. 10, 2004

(51) Int. Cl.[7] ..... D02J 3/02
(52) U.S. Cl. ..... 28/247; 28/219
(58) Field of Search ..... 28/247, 252, 258, 28/259, 282, 219, 217, 220; 26/28; 57/3, 6, 309, 331, 332, 334, 341, 342, 344, 351; 451/177, 180

(56) References Cited

U.S. PATENT DOCUMENTS

| | | | | |
|---|---|---|---|---|
| 1,957,508 A | | 5/1934 | Taylor | |
| 2,241,206 A | | 5/1941 | Koster | |
| 2,244,333 A | | 6/1941 | Hanse | |
| 2,273,752 A | * | 2/1942 | Frey | 28/220 |
| 2,278,879 A | | 4/1942 | Hunter | |
| 2,464,897 A | | 3/1949 | Scull | |
| 3,007,298 A | | 11/1961 | Williams et al. | |
| 3,140,526 A | * | 7/1964 | Tlamicha | 28/219 |
| 3,229,347 A | | 1/1966 | Tlamicha | |
| 3,499,195 A | * | 3/1970 | Wethington | 28/219 |
| 3,831,360 A | | 8/1974 | Horvath | |
| 3,914,929 A | | 10/1975 | Adachi et al. | |
| 3,928,958 A | | 12/1975 | Kurata et al. | |
| 3,946,548 A | | 3/1976 | Hino et al. | |
| 4,074,511 A | * | 2/1978 | Chambley et al. | 28/220 |
| 4,100,725 A | * | 7/1978 | Magel | 28/276 |
| 4,259,393 A | * | 3/1981 | Marco | 28/271 |
| 4,292,799 A | | 10/1981 | Otaki et al. | |
| 4,307,565 A | | 12/1981 | Sasaki et al. | |
| 4,333,307 A | | 6/1982 | Schuster et al. | |
| 4,365,466 A | | 12/1982 | Horiuchi et al. | |
| 4,395,873 A | * | 8/1983 | Frys | 57/334 |
| 4,501,046 A | | 2/1985 | Krenzer | |
| 4,674,271 A | | 6/1987 | Bird | |
| 4,944,751 A | | 7/1990 | Yamada | |
| 5,081,753 A | | 1/1992 | Fink et al. | |
| 5,099,642 A | * | 3/1992 | Rader et al. | 57/339 |
| 5,752,300 A | * | 5/1998 | Dischler | 26/28 |
| 5,956,828 A | | 9/1999 | Chiou et al. | |
| 6,012,206 A | | 1/2000 | Goineau | |
| 6,122,807 A | * | 9/2000 | Beltramini | 26/28 |

FOREIGN PATENT DOCUMENTS

GB 2076437 12/1981

* cited by examiner

*Primary Examiner*—Amy B. Vanatta
(74) *Attorney, Agent, or Firm*—Terry T. Moyer; Sara M. Current

(57) ABSTRACT

A process for forming a continuous filament yarn having the surface tactile character of a spun yarn. The process includes passing the cohesive yarn structure through the interior of a rotating sleeve member disposed in surrounding relation to the cohesive yarn structure. The rotating sleeve member includes an abrasive inner surface of diameter greater than the cohesive yarn structure and is adapted to contact the exterior surface of the cohesive yarn structure such that at least a portion of the elongate filaments disposed at the exterior of the cohesive yarn structure are broken. Terminal ends of the broken filaments define an arrangement of outwardly projecting hairs at discrete locations disposed substantially around the circumference of the cohesive yarn structure. An apparatus for carrying out the process is also provided.

40 Claims, 10 Drawing Sheets

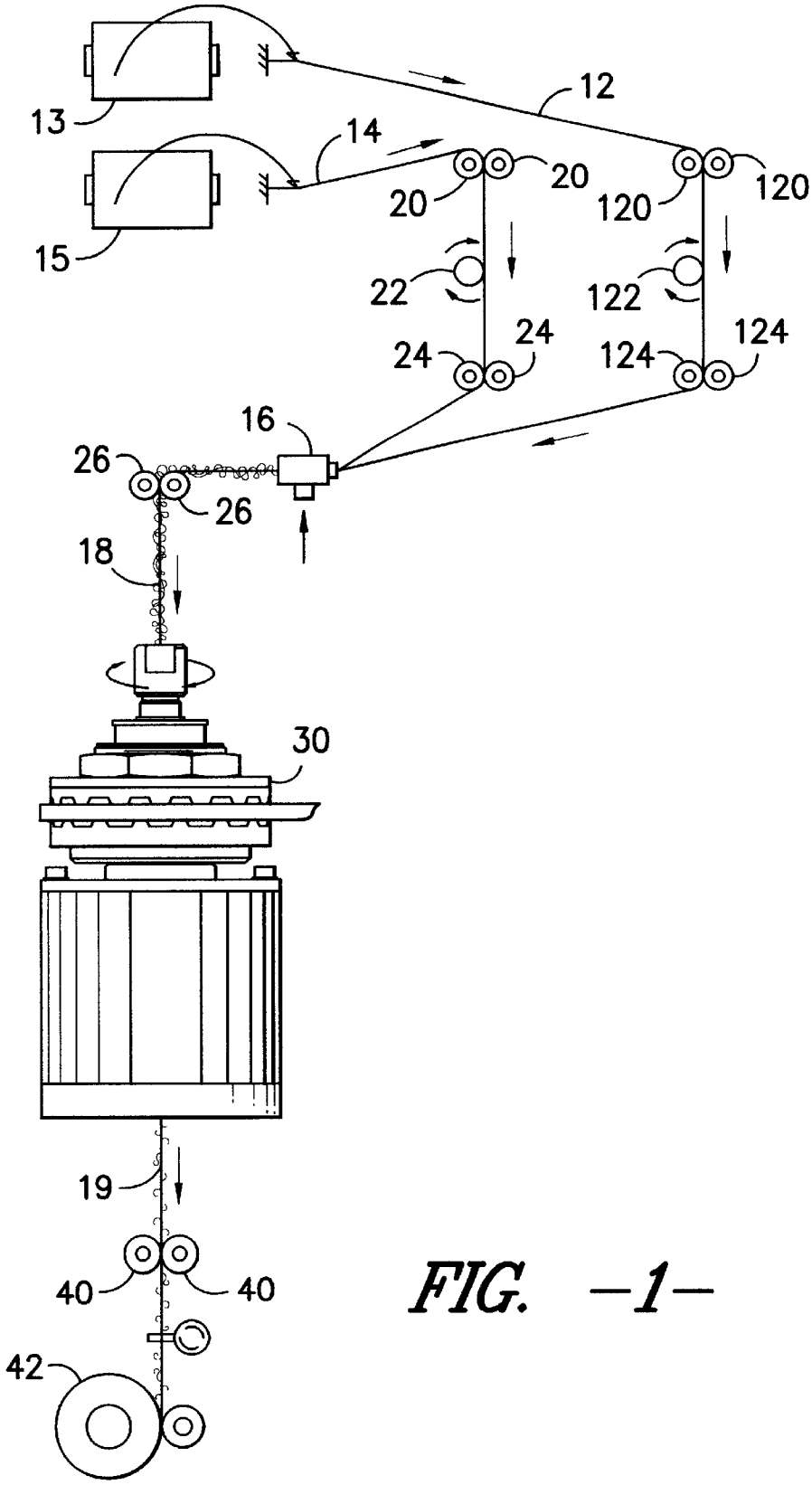
FIG. —1—

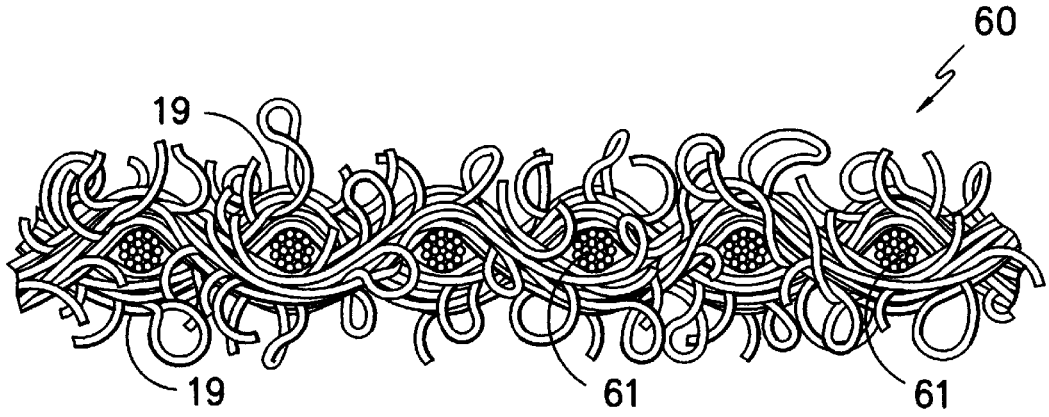
FIG. –10–
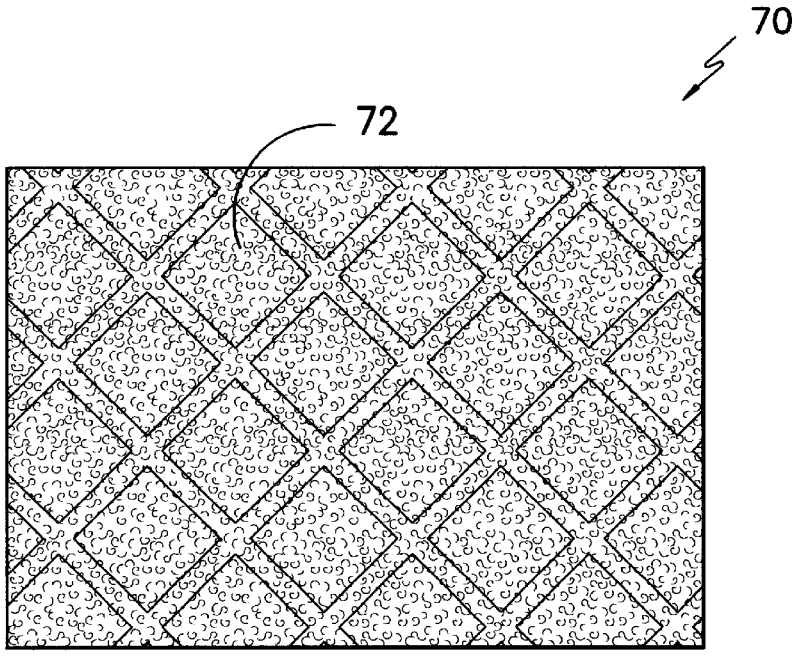
FIG. –11–

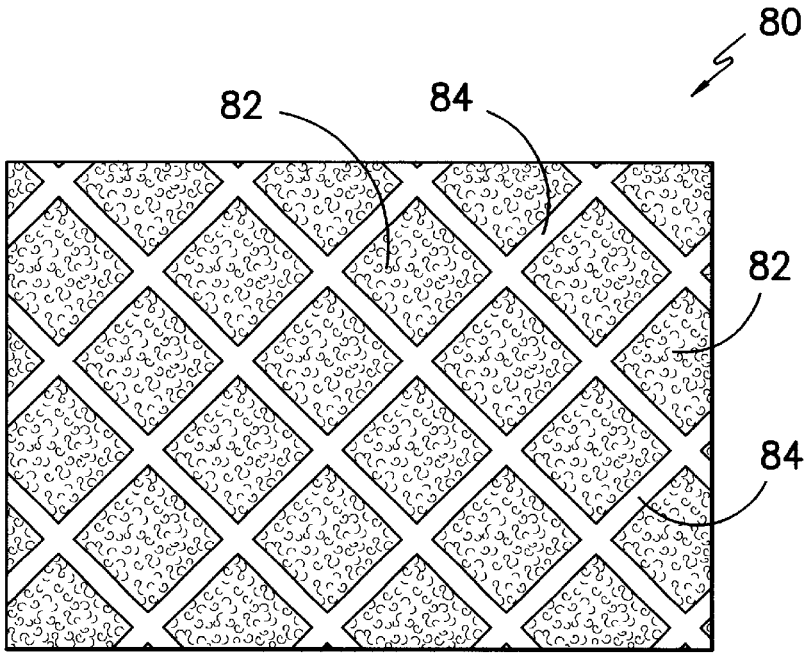
FIG. –12–
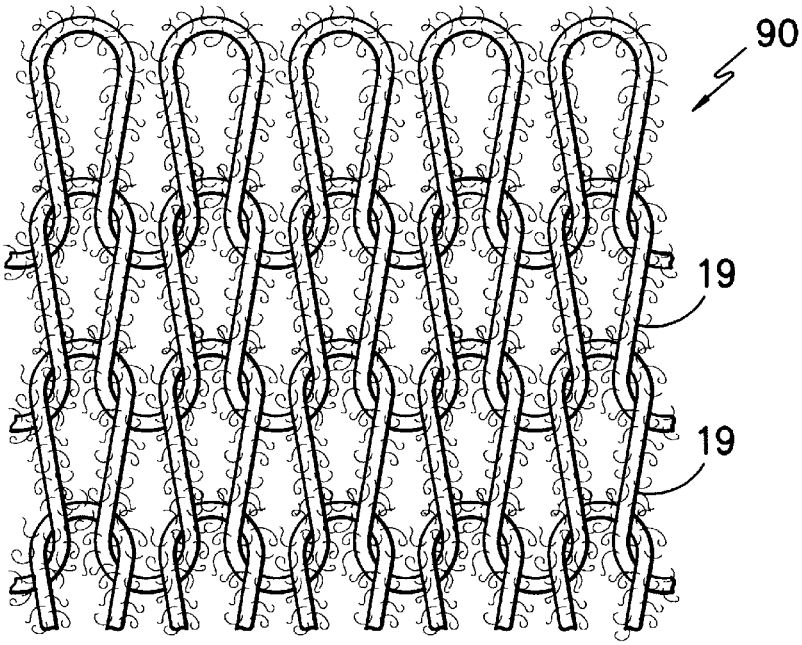
FIG. –13–

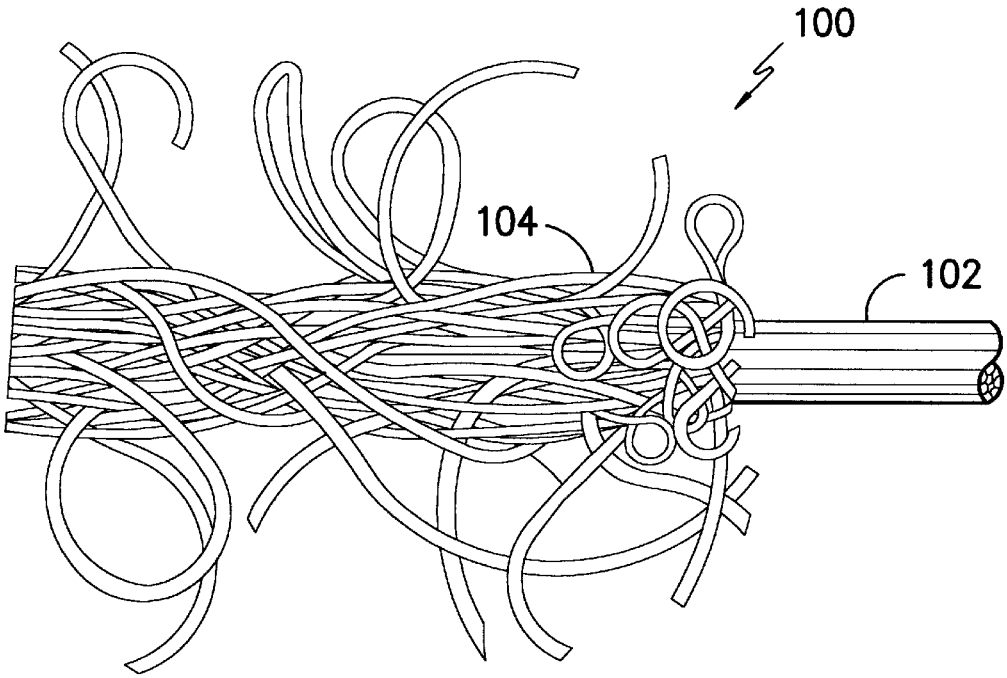
FIG. –14–
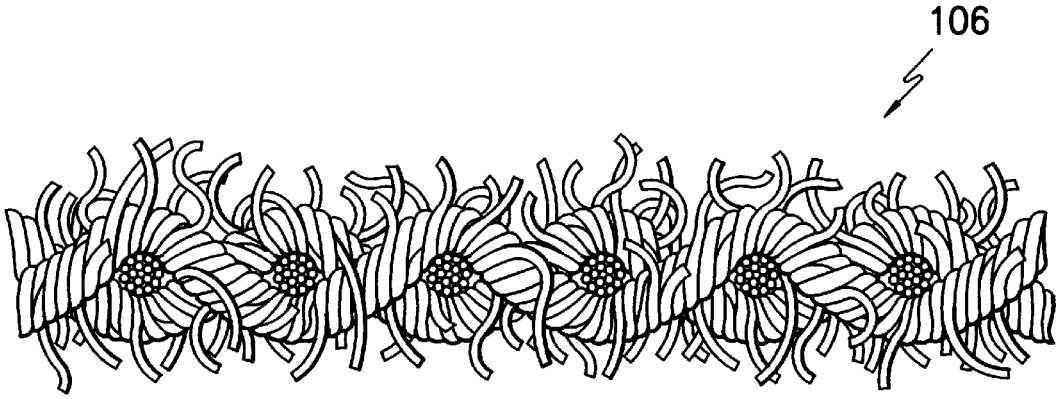
FIG. –15–

TREATMENT OF FILAMENT YARNS TO PROVIDE SPUN-LIKE CHARACTERISTICS AND YARNS AND FABRICS PRODUCED THEREBY

TECHNICAL FIELD

This invention relates to a yarn treatment process, equipment to carry out such yarn treatment, yarns produced by such yarn treatment and fabrics formed from such yarns. More particularly, the present invention relates to a process for breaking filaments within a filament yarn substantially around the circumference of such filament yarn so as to impart a surface texture with appearance and feel similar to that of a spun yarn. This process imparts circumferential abrasion to a filament yarn formed from a multiplicity of continuous filaments assembled without requiring or imparting substantial twist within the yarn bundle so as to break a portion of the filaments at the surface. The resulting yarn has a texture and appearance similar to that of a spun yarn formed of short length staple fibers.

BACKGROUND OF THE INVENTION

Two generally recognized classes of yarn are spun yarns and filament yarns. Spun yarns are typically formed by techniques such as open end spinning, ring spinning and air-jet spinning in which relatively short staple fibers having lengths in the range of about several inches are bound together in a generally stable yarn structure by twist between the discrete staple fibers. Due to the relatively short length of the staple fibers, a portion of the staple fibers tend to project away from the main body of the yarn thereby imparting a textured or hairy surface. Such a textured surface may be desirable to impart a generally soft feel to the yarn and the fabrics formed therefrom.

Filament yams are generally composed from an assemblage of so-called continuous or endless filaments of substantial length which are assembled together by practices such as air-jet entanglement or the like. Such filament yams have the advantage of being produceable from substantially continuous lengths of polymer filaments without requiring such filaments to be cut into discrete staple lengths and undergoing a spinning operation. However, due to the continuous nature of the filaments used in a filament yam, such a yarn is typically substantially free of upstanding fibers defining hair along its length. Thus, the texture of a traditional filament yarn is substantially different from that of a spun yam. Fabrics formed from traditional filament yams may thus have a smooth untextured appearance and may lack the soft hand characteristics which may be desirable in applications where physical contact is contemplated.

In the past, attention has been given to finding appropriate methods by which the desirable characteristics of conventional spun yam, (e.g. appearance, bulk and hand) may be imparted to synthetic continuous filament yam. In particular, known processes exist for sanding fabrics formed from filament yams so as to raise fibrils along the filaments forming the yams. It is also known to subject filament yams to so-called "false twist texturing" or "air-jet texturing" in which the yarn is treated to impart bulk and texture as will be well known to those of skill in the art. It is also known to impart high bulk characteristics to yams to produce a so called "core and effect yam" to yield an arrangement of loops and the like on the periphery of the yam core. While these various processes are both useful and advantageous to increase the apparent volume of a filament yam, such techniques typically do not yield substantial numbers of outwardly projecting hair-like elements around the yarn surface and thus do not substantially simulate the characteristics of a traditional spun yarn. That is, while the bulked filaments at the surface of such treated yarns provide the benefit of enhancing bulk in the yarn while also improving the perceived tactile character, the hand of fabrics formed from such false twist yarn may still be inferior to that of spun yarns due to the generally smooth profile of the loops and the lack of hairiness from discrete fiber segments projecting outwardly away from the yarn.

Aside from the known bulking operations, it has also been proposed to utilize various treatments to break surface filaments by frictional forces to impart a degree of hairiness along the yarn length. However, such practices have typically required relatively complex arrangements of equipment which do not treat the entire surface of the yarn and which are susceptible to the risk of damaging the yarn unless the processes are operated with substantial control. Exemplary processes which utilize a series of rolls for carrying a bulked yarn and pulling a portion of the surface fibers away from the bulked yarn to enlarge and/or break those surface fibers are illustrated and described in U.S. Pat. Nos. 4,501,046 and 6,012,206 the contents of which are incorporated by reference as if fully set forth herein. In such processes, the surface filaments are primarily pulled away from the periphery of the yarn with breakage being only incidental to the pulling action as filaments are stretched beyond their breaking point. Accordingly, such processes yield a relatively small number of broken filaments of substantial length. Moreover, since the pulling action is highly dependent upon the yarn itself as the friction inducing component, changes in the yarn such as changes in denier, tension, etc. require relatively complex adjustment. A further drawback is that operation of such a device requires a highly skilled operator.

SUMMARY OF THE INVENTION

The present invention provides advantages and alternatives over the known art by providing a method for circumferentially breaking a portion of the filaments at the surface of the yarn using an abrasive coated rotating sleeve element disposed in surrounding relation to the yarn along the yarn path. The yarn treatment is thus able to be carried out substantially without requiring deviation from a straight yam conveyance. The rotating sleeve element breaks a percentage of the filaments at the surface of the yarn by the dual action of pulling the filaments away from the yarn and severing the segments pulled away by an abrasive surface at the interior of the sleeve. A portion of the broken ends remain free standing projecting away from the yam bundle. A portion of the filaments pulled away from the yarn bundle are bent into a kinked geometry having a sharp radius of curvature which substantially mimics a free standing broken filament. A portion of the longer broken filaments which are carried by centrifugal forces partially wrap around the yarn bundle or may be reinserted back into the yarn bundle. Thus, a relatively large number of hair-like elements are formed such that both hairiness and overall aesthetics of the yarn may be enhanced.

BRIEF DESCRIPTION OF THE DRAWINGS

The present invention will now be described by way of example only, with reference to the accompanying drawings which constitute a part of the specification herein and in which:

FIG. 1 is a schematic drawing of a process for the manufacture of an air-jet entangled core and effect filament yarn texturized to have spun-like characteristics;

FIG. 10 is a sectioned side view of a woven fabric formed from a centrifugally texturized yarn according to the present invention;

FIG. 11 is a surface plan view of a fabric incorporating an integral profiled pattern of raised and lowered surfaces;

FIG. 12 is a surface plan view of a fabric incorporating a patterned surface of segments with variable texture across the surface;

FIG. 13 illustrates a loose knit fabric formed from texturized yarns according to the present invention;

FIG. 14 illustrates an exemplary yarn incorporating a core of elastomeric yarn fibers and a circumferentially texturized surrounding effect yarn providing hairiness around the elastomeric core; and FIG. 15 illustrates an exemplary woven fabric formed from the yarn of FIG. 14.

Figure 1A:
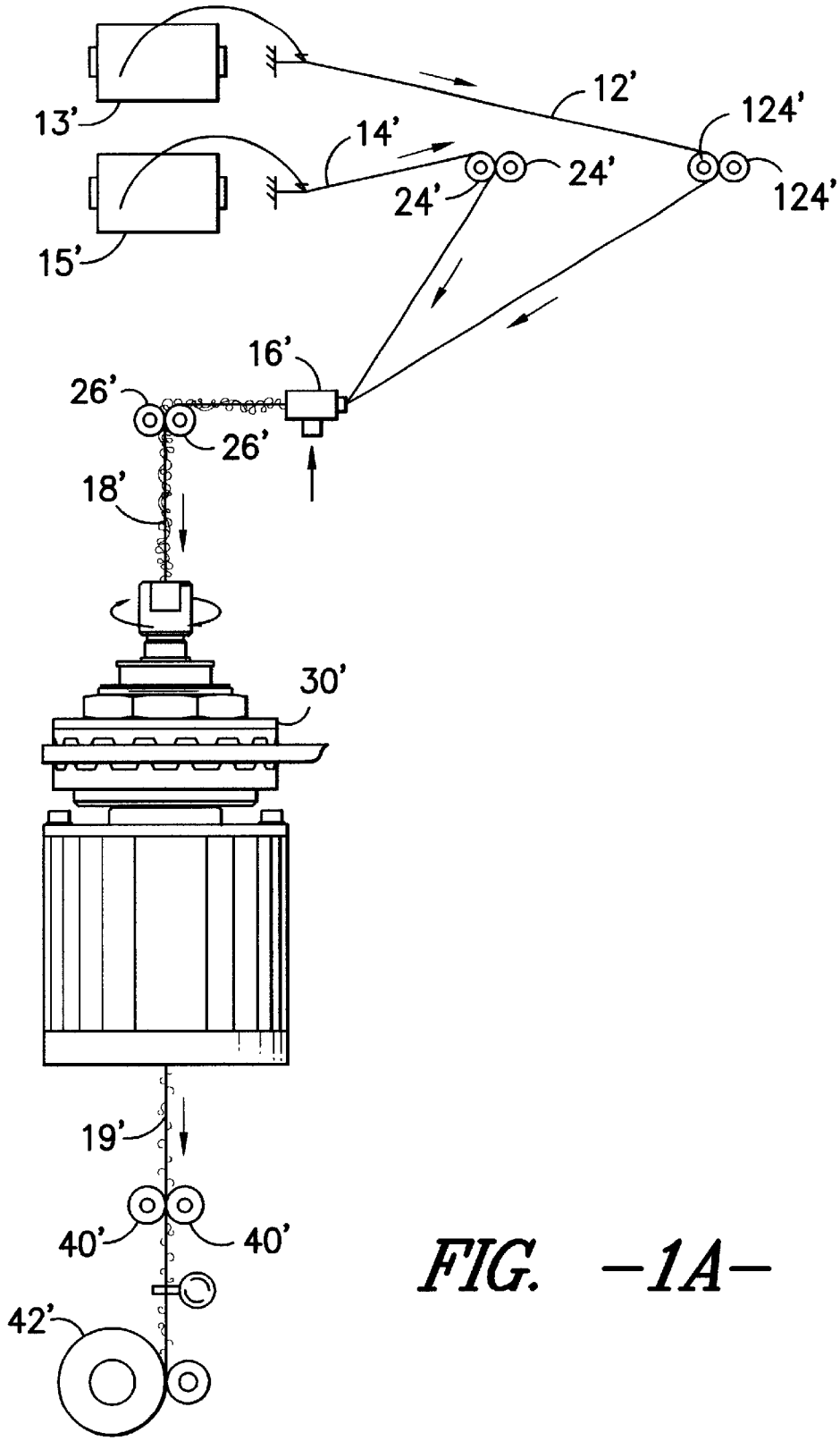
FIG. 1A is a schematic drawing of a process for commingling package dyed yarns and subsequently imparting spun-like surface character.

While the invention has been generally described above and will hereinafter be described in connection with certain illustrated embodiments, procedures and practices, it is to be understood that in no event is the invention to be limited to such illustrated and described embodiments, procedures and practices. On the contrary, it is intended that the present invention shall extend to all alternatives and modifications as may embrace the broad inventive principles of this invention within the true spirit and scope thereof.

DETAILED DESCRIPTION

Exemplary embodiments of the invention will now be described by reference to the accompanying drawings. Looking now to FIG. 1, an overall system is shown for forming an air-jet entangled core and effect filament yarn having spun-like feel. In the illustrated process, continuous filament yarns 12, 14 are delivered from yarn packages 13, 15 for drawing, entangled merger, texturizing and bulking at an air-jet 16 in a manner as will be well known to those of skill in the art so as to form an air jet textured yarn 18 which may be subjected to circumferential filament breakage as will be described further hereinafter.

During the bulking and entangling operation at the air jet 16, the starting continuous filament yarns 12, 14 are merged into a substantially cohesive structure in which individual filaments are entangled to form a yarn bundle and with a portion of the filaments forming loops and the like along the surface of the bulked entangled yarn 18. Such surface loops are generally unbroken in character. In practice, it is contemplated that the starting continuous filament yarns 12, 14 may be of virtually any continuous filament construction. By way of example only, one contemplated construction for the starting continuous filament yarns 12, 14 is a 255/68 continuous filament polyester yarn although yarns of other materials including PLA (polylactic acid), nylon, polypropylene, Rayon, NOMEX® (meta-aramid), KEVLAR® (aramid) and the like may also be utilized. Likewise, it is contemplated that yarns of virtually any desired construction may be utilized including yarns made up of relatively large denier filaments as well as yarns made up of small denier filaments. By way of example only, and not limitation, it is contemplated that the practice according to the present invention may be particularly beneficial in the treatment of so called "supermicro" yarns made up of filaments having denier per filament (dpf) ratings of less than about 0.6 denier per filament.

As will be appreciated, virtually any number of starting continuous filament yarns may be utilized in carrying out the process. Thus, while two such starting continuous filament yarns 12, 14 have been illustrated, it is likewise contemplated that a single continuous filament yarn may be utilized or that three or more starting continuous filament yarns may be utilized without departing from the principles of the invention. The bulked, entangled yarn 18 subjected to circumferential filament breakage according to the present invention may be of virtually any linear density ranging from about 30 denier to about 10,000 denier or more.

According to one contemplated practice the starting continuous filament polyester yarn 14 is used as a core yarn and is drawn through a first set of rolls 20 at a speed of about 302 meters/minute and is wrapped around a hot pin 22 maintained at a temperature of about 155° C. The filament polyester yarn 14 thereafter passes through a second set of rolls 24 at a rate of about 520 meters/minute prior to being delivered to the air-jet 16. Concurrently with the delivery of the filament polyester yarn 14 to the air-jet 16, the polyester filament yarn 12 which is used as a surface effect yarn is conveyed through a set of rolls 120 at a speed of about 343 meters/minute and is wrapped around a hot pin 122 maintained at a temperature of about 155° C. The polyester filament yarn 12 is thereafter passed through a second set of rolls 124 at a rate of about 590 meters per minute prior to being delivered to the air-jet 16. Thus, the filament yarn 12 is delivered to the air-jet 16 at a higher rate than the filament yarn 14.

At the air-jet 16, air is supplied at a pressure of about 150 psi to effect the desired entanglement and bulking of the starting continuous filament yarns 12, 14. The entanglement and bulking is facilitated by operating exit rolls 26 so as to withdraw the bulk entangled yarn 18 from the air-jet 16 at a rate of about 473 meters/minute which is slightly less than the feed rate of either yarn into the air-jet. That is, due to the lower speed of the exit rolls 26, relative to the rolls 24, 124 feeding yarn into the air-jet 16, the merged yarns entangle one another generating the desired bulked entanglement with surface loops along the length of the resulting bulked entangled yarn 18.

According to the illustrated practice, the bulked entangled yarn 18 is delivered to a circumferential rotating filament breaker 30 including an abrasive coated sleeve element 31 (FIG. 5) in the form of an elongate tube which rotates in surrounding relation to the bulked entangled yarn 18 thereby causing a portion of the filament loops at the surface of the bulked entangled yarns to be broken in a manner so as to generate a surface textured yarn 19 including an arrangement of broken and kinked filament ends along its length. As illustrated, upon exiting the circumferential filament breaker 30, the surface textured yarn 19 with broken and kinked filament ends along its length is conveyed through rolls 40 at a speed of about 500 meters/minute to a take-up package 42 taking up yarn at a rate of about 479 meters/minute.

Of course, it is to be understood that the air-jet entangling treatment described above can be readily adapted to produce a so called "parallel" construction rather than a core and effect construction. In order to produce such a parallel construction, the starting continuous filament yarns 12, 14 are delivered to the air-jet at the same rate.

In accordance with the present invention it is contemplated that the practice as generally illustrated in FIG. 1 may be readily adapted to treat a wide variety of yarn types. In the event that the yarn being treated is solution dyed yarn, it is contemplated that the process may be carried out substantially as illustrated and described in relation to FIG. 1. In the event that the yarn being treated is package dyed yarn, it is contemplated that the process may be slightly modified in the manner as illustrated in FIG. 1A in which elements corresponding to those in FIG. 1 are designated by like reference numerals with a prime.

As illustrated, in the treatment of package dyed yarns 12', 14' such yarns may be delivered directly to rolls 24', 124' without intermediate heating. In such a practice the rolls 24', 124' typically deliver yarn at the same speed. The package dyed yarns are thereafter delivered into a commingling jet 16' for formation of a commingled yarn structure 18' which may the be treated at the circumferential filament breaker 30'. As will be appreciated, while FIG. 1A illustrates the commingling of two package dyed yarns 12', 14' it is likewise contemplated that the illustrated treatment may be carried out on a single yarn either with or without a jet 16' as well as on three or more yarns if desired.

Figure 2:
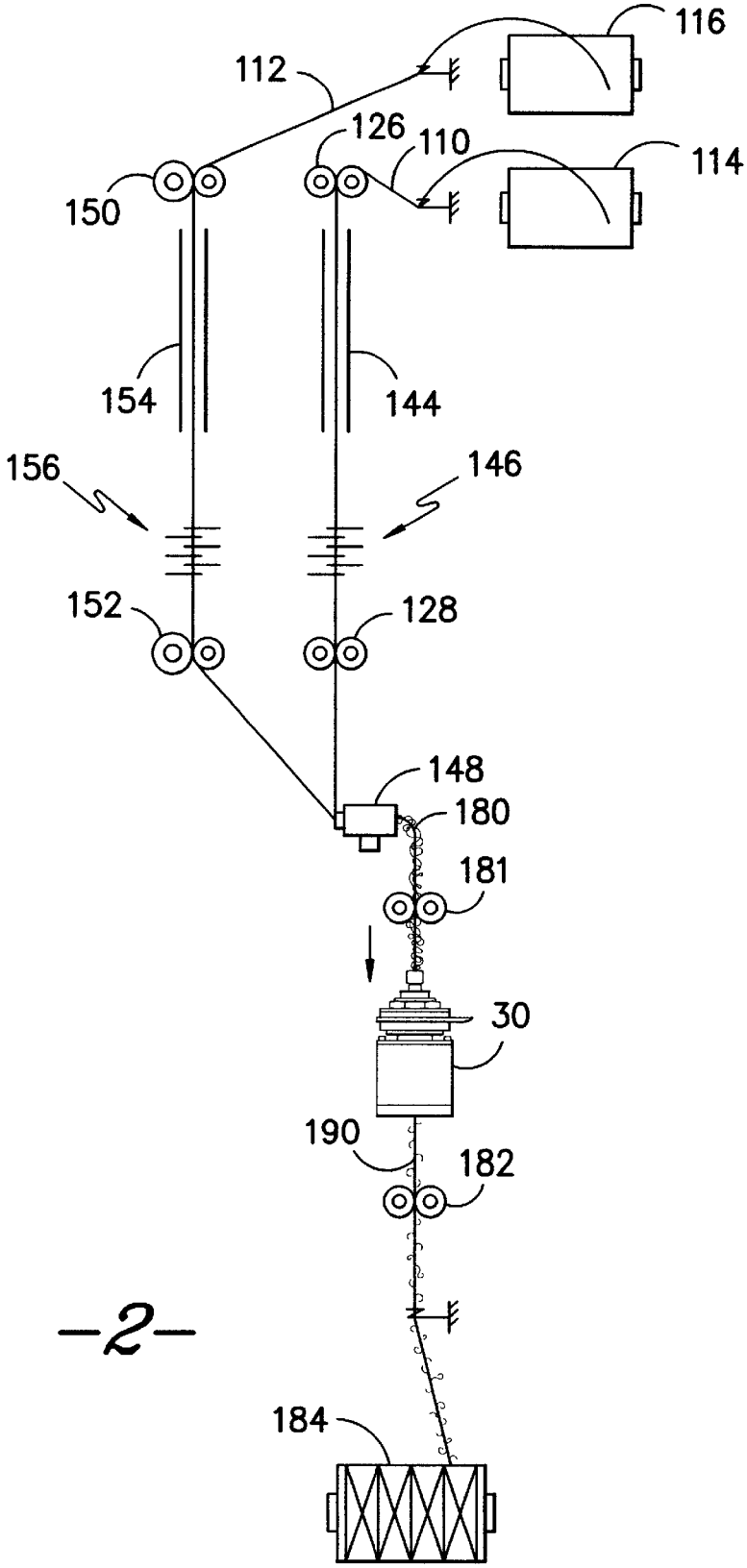
FIG. 2 is a schematic drawing of a process for the manufacture of false twist textured two ply commingled continuous filament yarn having spun-like characteristics.

Looking to FIG. 2, another exemplary process for forming a spun-like synthetic yarn according to the present invention is illustrated wherein the resulting yarn is of a so-called "paralleled" false twist construction in which multiple plys are delivered through parallel false twist zones at substantially the same rate. Of course, it is also contemplated that the starting yarns may be delivered at different rates if desired. In the process illustrated in FIG. 2, a first yarn 110 and a second yarn 112 are delivered from yarn packages 114, 116. According to one contemplated practice, both the first yarn 110 and the second yarn 112 are continuous, multi-filament yarns formed of materials such as partially or fully oriented polyester. However other synthetic continuous multi-filament yarns including those previously listed may also be employed if desired. As illustrated, the first yarn 110 is delivered from the yarn package 114 by a set of delivery rolls 126 to a primary heater 144. A second set of delivery rolls 128 thereafter pulls the yarn 110 out of the primary heater 144 and through a false twist device 146 such as an arrangement of friction discs or the like. The first yarn 110 is thereafter delivered to a bulking and entangling unit 148 such as a commingling air-jet as will be well known to those of skill in the art.

Concurrently with the delivery of the first yarn 110 to the bulking and commingling unit 148, the second yarn 112 is delivered from a yarn package 116 to the false twist zone by a set of delivery rolls 150, 152 such that the second yarn 112 passes through a primary heater 154 and a false twist device 156 such as an arrangement of friction discs or the like. The second yarn 112 is thereafter transported to the commingling unit 148 where it is merged with the first yarn 110 to yield commingled yarn 180 which is thereafter passed through a pair of rolls 181 for delivery to a circumferential filament breaker 30 which may be of the same construction as used in filament breakage in the air-jet textured yarn in FIG. 1. The surface textured yarn 190 leaving the circumferential filament breaker 30 is thereafter drawn by a pair of take-up nip rolls 182 to a take-up roll 184.

While the actual operation of the false twist texturizing unit may be subject to wide variation, according to one exemplary practice the yams 110, 112 are both 255 denier, 68 filament, partially oriented polyester yam. The resultant combined yam 180 has a linear density of about 317 denier. The combined yarn 180 is formed under the following parameters wherein yarns 110 and 112 are treated in a like manner:

Yarn velocity into primary heaters=349 meters/minute;

Yarn velocity into commingling unit=600 meters/minute;

Primary heater temperature for both yams=195 degrees Celsius;

Air pressure at commingling unit=55 psi;

Yarn velocity at rolls 181 preceding the circumferential filament breaker=582 meters/minute;

Yarn velocity at rolls 182 after the circumferential filament breaker=606 meters/minute;

Combined yarn take-up velocity=564 meters per minute.

Of course, such operating parameters are exemplary only and may be readily adjusted as desired.

Regardless of the actual construction of the filaments yams being utilized, it is contemplated that the circumferential filament breaker 30 (FIG. 5) will be made up of a rotating circumferential sleeve member 31 operated substantially in-line with t he entangled yarn 18 (FIG. 1), 180 (FIG. 2). It is to be understood that by the term "circumferential sleeve member" is meant any structure disposed in surrounding relation to the yarn such that the yarn may pass through an interior of the sleeve element. Surprisingly, it has been found that a filament breaker utilizing such a circumferential sleeve member 31 which is rotated around the yarn during yam conveyance may provide excellent texturizing around the entire circumference of the yarn being treated without introducing interruption to the yarn formation practices and without the necessity of multi-staged filament breakage assemblies such as are required in prior U.S. Pat. Nos. 4,501,046 and 6,012,206. Moreover, the controlled operation of a rotating circumferential sleeve member along the yarn path has been found to generate an arrangement of broken and kinked yarn ends along the length of the treated yarn which provide the yarn with excellent hairiness along the length of the treated yam.

Figure 5:
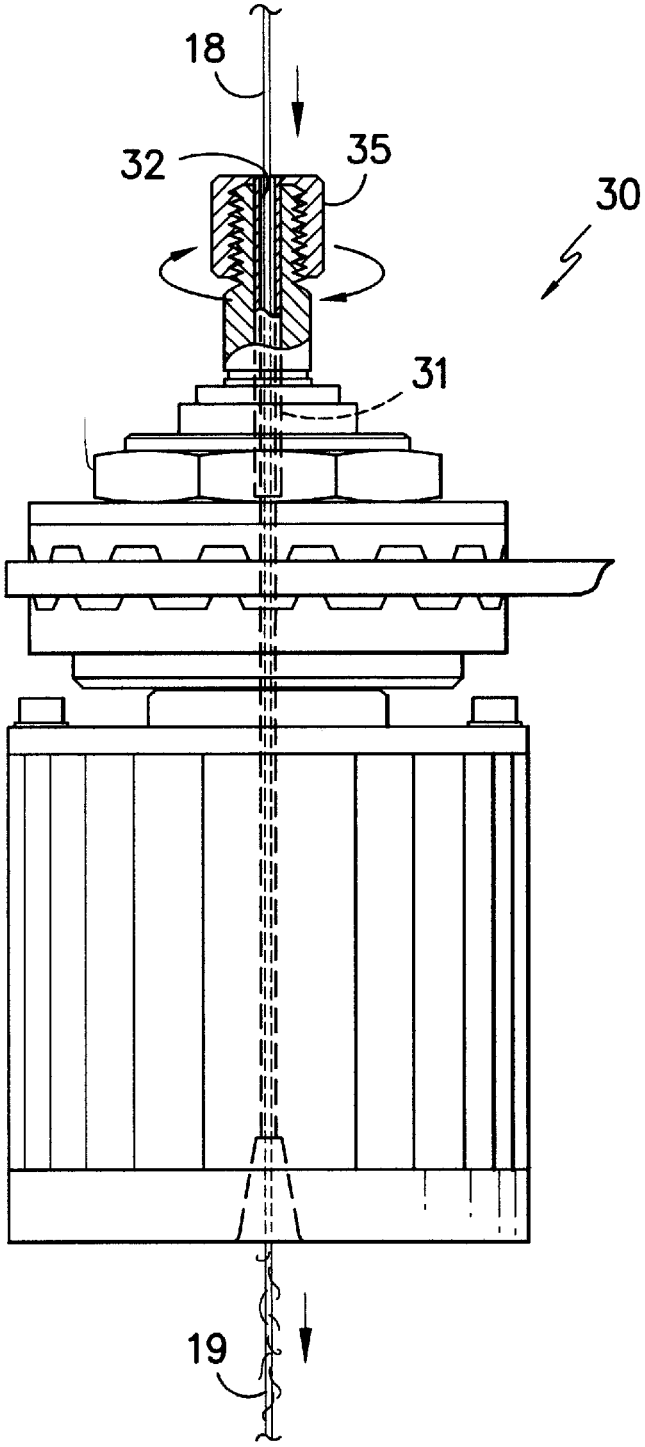
FIG. 5 illustrates an apparatus for imparting circumferential yarn breakage to a filament yarn in a continuous in-line process.
Figure 6:
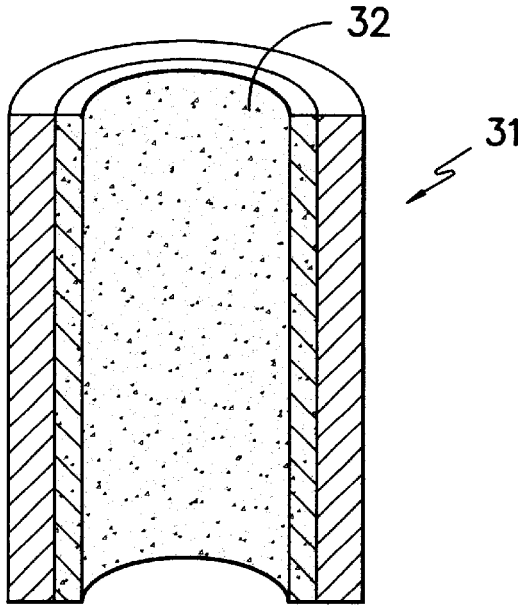
FIG. 6 is a partial cut-away view of a sleeve element including an abrasive inner coating for circumferential abrasion of a yarn.

In FIG. 5 there is illustrated one exemplary construction for a circumferential filament breaker 30 as may be utilized for in-line treatment of both air-jet and false twist filament yams 18, 180. As indicated, the circumferential filament breaker 30 includes a rotating tubular sleeve member 31 disposed along the processing line downstream of an entangling unit 16, 148 such as an air-jet entangling or commingling unit or t he like at which the filament s of the yarn components are textured and combined so as to form an arrangement of surface loops and/or raised textured filaments disposed along the length of the yarn. Thus, the bulked yarn 18, 180 entering the circumferential filament breaker 30 has an arrangement of surface filaments of substantially unbroken character disposed along its length.

The rotating tubular sleeve member 31 preferably includes an inner surface 32 of substantially abrasive character so as to effect abrasive breakage of at least a portion of the loops/filaments disposed at the surface of the yarn 18, 180 entering the sleeve member 31. According to one contemplated practice, the inner surface 32 is covered with diamond grit made up of diamond particles in the range of about 100 microns although other grit sizes and materials may likewise be utilized. By way of example only, and not limitation, it is contemplated that other materials which may be useful may include garnet, carborundum or the like which have a hardness sufficient to promote long-term usage without undue wear.

Surprisingly, it has been found that the diameter of the passage surrounded by the inner surface 32 does not require substantial adjustment to accommodate yams of various size. In particular, a sleeve member 31 having an inner diameter of about 4 mm may successfully treat filament yams having linear densities ranging from about 40 denier up to about 10,000 denier. The inner diameter of the sleeve member 31 is preferably such that the yarn is substantially freely moveable within the sleeve member 31. That is, the yarn is preferably not held in fixed contact with the inner surface 32 of the sleeve member. This permits the yarn to vibrate between touching and non-touching relation relative to portions of the inner surface 32 without undergoing undue stress as the yarn moves through the sleeve member 31. That is, the inner surface 32 rapidly contacts and then releases the yarn as the yarn vibrates between portions of the inner surface. The selection of such a sleeve member 31 causes the inner surface 32 including the outwardly projecting diamond grit or other abrasive material to contact the yarn being treated substantially only at the outer surface of such yarn as the yarn moves through the sleeve member 31 such that high profile loops and surface filaments along the yarn are broken while the interior of the yarn bundle remains substantially unaffected. Such limited surface engagement provides the desired tactile effects while maintaining the strength of the overall structure.

Figure 7:
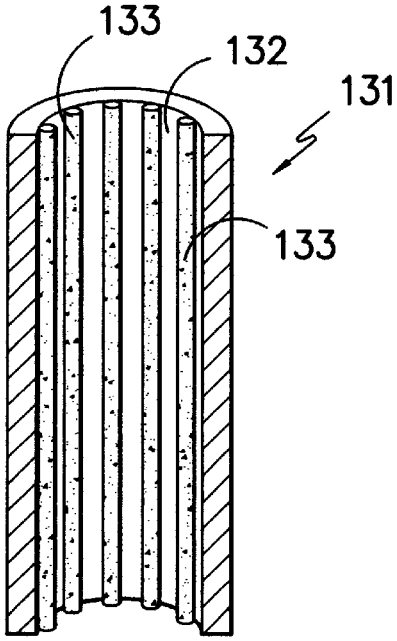
FIGS. 7 and 7A illustrate alternative constructions for a rotating sleeve element for use in applying circumferential abrasion to a yarn wherein abrasive elements are disposed in spaced relation around the interior of the sleeve element.
Figure 7A:
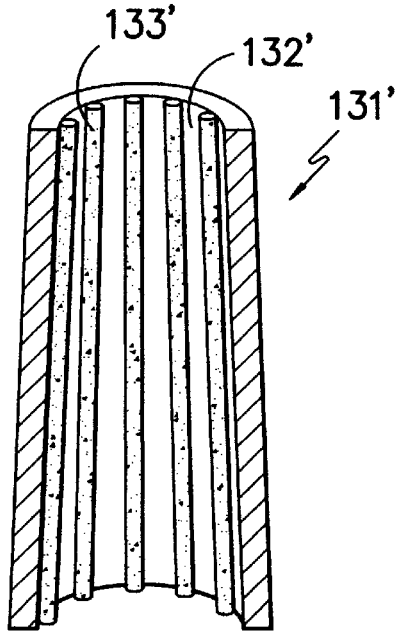

It is contemplated that the rotating sleeve member imparting circumferential filament abrasion may be of any number of different constructions and is in no way limited to a straight tubular geometry. By way of example only, in the construction illustrated in FIG. 7 the sleeve member 131 includes an inner surface 132 with a multiplicity of abrasive coated rod elements 133 disposed around the inner diameter so as to define an abrasive contact surface for yarn engagement. In such an arrangement it is contemplated that the rod elements 133 may be either stationary or rotatable as desired. In the construction illustrated in FIG. 7A, a multiplicity of abrasive coated rod elements 133' are disposed around the inner diameter of the sleeve member 131'. However, in this construction the inner surface 132' defines a tapered surface expanding from a reduced inner diameter to an enlarged inner diameter in the travel direction of the yam. It is contemplated that such a tapered interior may be used to control yarn treatment along the length of the sleeve member 131'. While the construction illustrated in FIG. 7A widens in diameter along its length, it is likewise contemplated that the inner surface may taper to a reduced width if desired. Of course, it is to be understood that either a widening or tapering inner surface may also be used in a sleeve member having a substantially uniform abrasive coating if desired.

Figure 8:
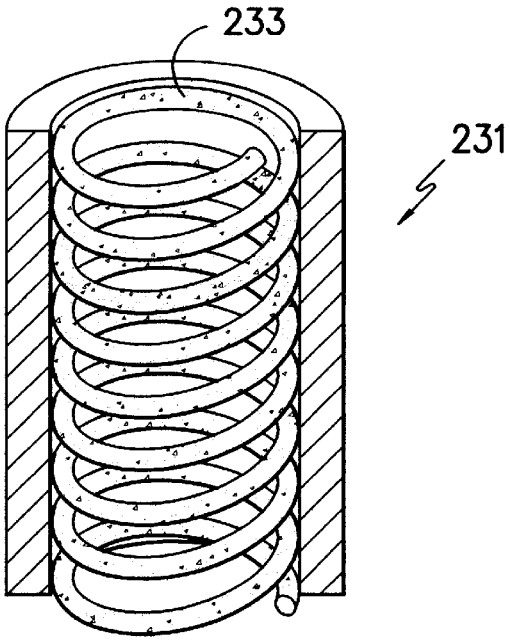
FIGS. 8 and 8A are cut-away views of rotating sleeve elements incorporating abrasive coated helix structures at the interior.
Figure 8A:
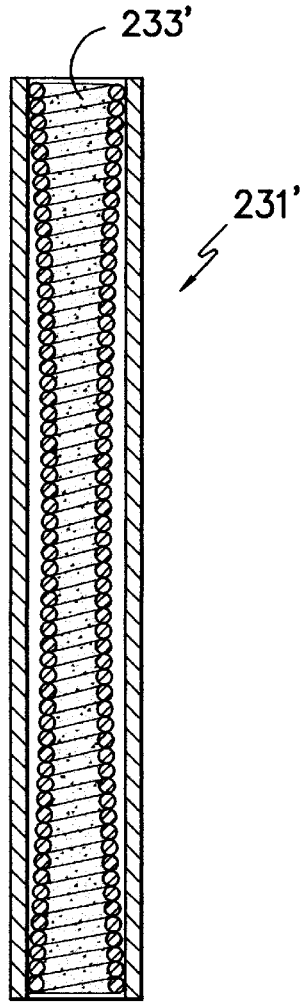

It is also contemplated that the sleeve member may incorporate other abrasive surface constructions wherein the geometry of the abrasive surface augments yarn treatment. By way of example only, and not limitation, FIG. 8 illustrates a rotatable sleeve member 231 housing an abrasive coated helix 233 such as a coated spring or the like disposed at the interior of the sleeve member 231. It is contemplated that the use of such a helix 233 may in some instances be beneficial in achieving full circumferential contact with a yarn being treated. In the event that a coated helix is utilized, it is contemplated that the helix may be either substantially uniform in inner diameter over its length or may be of a variable inner diameter so as to vary yarn treatment along the length of the helix. By way of example only, and not limitation, FIG. 8A illustrates one contemplated construction of a variable geometry helix 233' disposed at the interior of a sleeve member 231'. As shown, in this construction the inner diameter of the coated helix 233' is of a converging/diverging hourglass shape. However, virtually any other geometry including a tapered diverging geometry or tapered converging geometry may likewise be utilized if desired.

Figure 9:
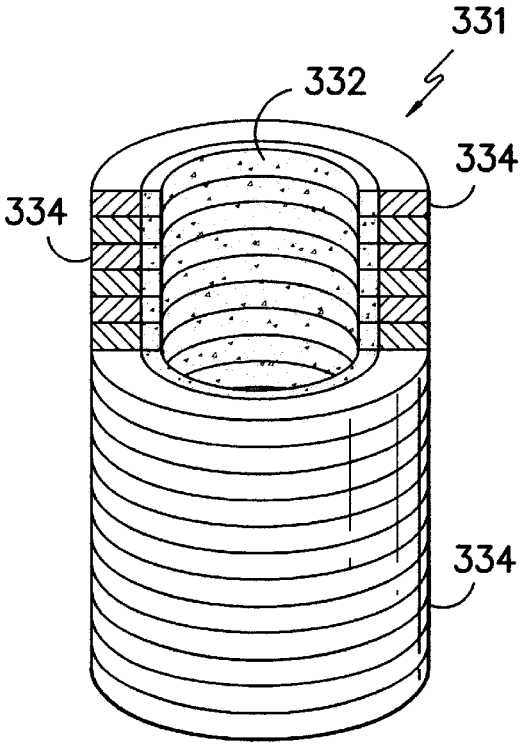
FIG. 9 is a partial cut-away view of a rotating sleeve element formed from an arrangement of stacked annular disc elements having abrasive coated inner surfaces.

It is also contemplated that the sleeve member may have a variable abrasive character along its length. By way of example only, one such arrangement is illustrated in FIG. 9 in which the sleeve member 331 is made up of a multiplicity of stacked discs 334 of substantially annular geometry. As illustrated, the discs 334 include abrasive coated inner surfaces 332 which cooperatively define an abrasive passageway for yarn treatment. Thus, by adjusting the abrasive character of the coating on individual discs or groups of discs, the abrasive character may be adjusted as desired along the length of the sleeve member 331. Of course, it is also contemplated that the discs used along the length of the sleeve member 331 may be of variable internal diameter at different segments of the sleeve member if desired so as to vary the diameter of the yarn passage and thus further adjust the yarn treatment.

Regardless of the actual construction of the sleeve member, it is contemplated that the sleeve member will be readily removable from the circumferential filament breaker 30 so as to permit replacement as needed. One construction of a circumferential filament breaker 30 which has been found to be particularly useful is an open ended motor spindle in which the sleeve member may be held in place by an adjustable chuck element 35 (FIG. 5). One suitable motor spindle is believed to be available from Temco GmbH & Company having a place of business in Hammelburg Germany.

Due to the limited engagement between the rotating sleeve member and the yarn passing therethrough, it has surprisingly been found that the yarn may be processed with a so-called zero net twist. That is, the yarn entering the rotating sleeve member need not be twisted prior to circumferential yarn breakage and the rotating member itself does not twist the yarn. Rather the action of the rotating sleeve member is substantially limited to the breakage and kinking of the loops and high profile filaments along the length of the yarn while causing virtually no disruption to the interior of the yarn bundle. Surprisingly, the resulting tactile character is extremely good even with such limited depth treatment.

The benefits of the process according to the present invention are believed to be attributable to the circumferential treatment action in which the high profile filaments and loops at the surface are carried circumferentially at least partially around the yarn bundle until breakage and/or kinking takes place. In this regard, it is believed that longer broken ends are either kinked or are transported at least partially around the yarn bundle by centrifugal forces while shorter filament ends remain projecting away from the yarn bundle. Both the outwardly projecting broken ends and the kinked segments serve to enhance perceived hairiness along the length of the yarn. This may be contrasted to broken ends which are formed by longitudinal elongation to the point of breaking which are not wrapped back around the yarn bundle or substantially kinked. In addition, such prior practices which rely upon longitudinal elongation to breakage may tend to make the yarn more lean by pulling fibers away from the interior bundle without rewrapping those fibers.

While it is possible to operate the circumferential filament breaker 30 across a wide range of speeds, according to one contemplated practice, the rotating tubular member 31 may be operated at a speed of about 30,000 revolutions per minute. Such a speed is preferably set so that the ratio of the rotating speed of the inner surface 32 to the linear velocity of the yarn passing through the circumferential filament breaker 30 is in the range of about 0.02 to about 5 and is more preferably in the range of about 0.2 to about 3.8 and is most preferably about 1. Such ratios are believed to promote a high degree of filament breakage at the surface without pulling the filament yarns to an extended length out of the yarn bundle. When operated according to such parameters, it is contemplated that the length of the broken ends extending away from the yarn bundle will typically be in the range of about 1 to about 8 millimeters.

It is contemplated that a distribution of broken filaments of different lengths will be disposed along the yarn following circumferential treatment in accordance with the present invention. Of course, the actual number of broken filaments will be dependent upon a number of factors such as yarn denier, yarn construction, rotational speed of the abrasive sleeve member and the abrasive character of the sleeve member. However, it is contemplated that after treatment the distribution of broken filaments will preferably include at least a percentage of broken ends having a length in excess of 2 millimeters. That is, it is believed that yams treated by circumferential filament breakage according to the present invention will include some number of broken filaments having a length in excess of 2 millimeters in length. It is contemplated that the total number of broken ends may be substantially adjusted by varying the rotational speed of the abrasive sleeve and/or the linear speed of the yarn passing through the sleeve. More specifically, in general it is contemplated that increasing the rotational speed will tend to increase the number of broken filament ends while increasing the speed of the yarn passing through the sleeve will tend to decrease the number of filament ends. Likewise, larger diameter yarns, everything else being the same, will typically yield a larger number of broken filaments while smaller diameter yams will yield a smaller number of broken filaments. Due to the fact that filament ends are broken substantially at the surface of the yarn without significant alteration of the yarn interior, it is anticipated that yarn treated according to the present practice will tend to substantially retain its strength through the treatment process.

In addition to broken filament ends, a substantial number of kinks which substantially mimic broken filament ends may also be present along the length of the yarn. The occurrence of such kinks is particularly pronounced in lower denier yams and yams having low dpf (denier per filament) ratings such as yams having dpf ratings in the range of about 2 dpf.

As previously indicated, yams treated in accordance with the present invention provide substantial tactile and appearance benefits normally associated with spun yams. In particular, the yams of the present invention may be used to form various fabrics in which an aesthetic character such as a wooly hand or a soft hand is beneficial. By way of example only, in FIG. 10 a flat woven fabric 60 is shown incorporating texturized filament yams 19 similar to those illustrated in FIG. 3 disposed in the fill direction of the fabric 60 in interwoven relation with a plurality of standard filament warp yams 61. As illustrated, in such a construction the broken and kinked filaments along the length of the texturized filament yams 19 provide an outer surface of fine hair-like fibers disposed across the fabric 60. Moreover, due to the full circumferential projection of the broken filaments the desired characteristics are provided on both faces of the fabric 60 without regard to the orientation of the texturized filament yams. Of course it is also contemplated that the texturized yam may be run in just the warp direction or in both the warp and the fill direction if desired.

Aside from flat woven fabrics, it is also contemplated that the yams texturized so as to have substantially full circumferential filament breakage may find application in various fabrics such a patterned knit fabrics, Jacquard woven fabrics and the like which incorporate surface patterning due to the yarn patterning arrangement utilized. An exemplary surface patterned fabric 70 incorporating an arrangement of profiled patterned segments 72 of raised and lowered character such as may be formed by patterned knitting or Jacquard weaving is illustrated in FIG. 11 As will be appreciated, surface patterned fabrics are typically not susceptible to traditional hand enhancing surface treatments such as sanding and the like due to the fact that the profiled patterned portions are subjected to undue wear while leaving the surrounding portions of the fabric untreated. However, it is contemplated that by incorporating yarns texturized so as to have substantially full circumferential filament breakage the need to carry out surface treatments may be avoided. Moreover, the use of such yarn within a surface patterned fabric may be carried out without undue complexity due to the fact that broken filaments are disposed substantially around the yarn thereby eliminating any need to orient the yarn in a particular manner.

While yarns texturized so as to have substantially full circumferential filament breakage may be utilized substantially uniformly across a knit or woven fabric, it is also contemplated that such textured yarns may be placed selectively within a woven fabric so as to impart a pattern of fabric portions of enhanced hairiness in combination with fabric portions of lower hairiness. By way of example only, and not limitation, a patterned fabric 80 such as a knit or woven fabric is illustrated in FIG. 12. As shown, the patterned fabric 80 includes alternating enhanced textured portions 82 formed using texturized yarns with full circumferential filament breakage and portions 84 of relatively lower surface texture which do not utilize texturized yarns with full circumferential filament breakage. Of course, the illustrated pattern is merely exemplary and virtually any other pattern may likewise be incorporated as desired.

It is also contemplated that texturized yams with full circumferential filament breakage may find application in fabrics which lack the rigidity to undergo traditional surface treatments. By way of example only, such fabrics may include loose knit fabrics as well as fabrics formed from elastomeric yams which tend to stretch when subjected to surface treatments.

Figure 3:
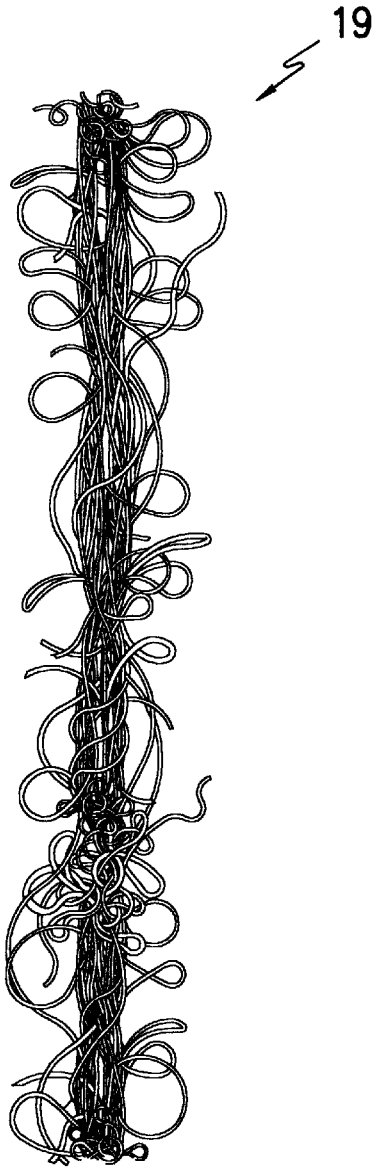
FIG. 3 illustrates an exemplary segment of air-jet entangled filament yarn showing texture imparting broken ends along the length of the yarn.
Figure 4:
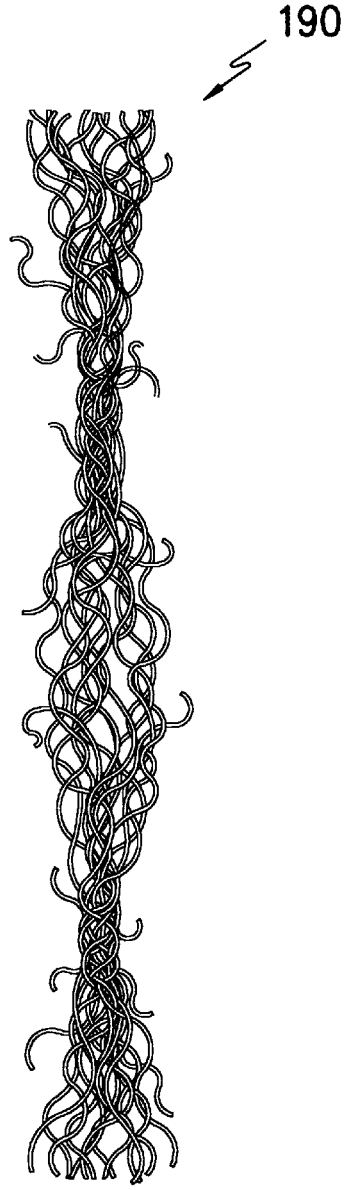
FIG. 4 illustrates an exemplary segment of false twist filament yarn with broken ends along the length of the yarn to impart spun-like characteristics.

In FIG. 13 there is illustrated an exemplary knit fabric 90 such as a circular knit fabric or the like which incorporates a relatively loose knitted arrangement of texturized yams with full circumferential filament breakage 19 such as is illustrated in FIG. 3. Of course, a false twist yarn such as is illustrated in FIG. 4 may likewise be utilized if desired. As will be appreciated, the use of texturized yams with full circumferential filament breakage in such a construction substantially eliminates any need for surface treatments which may damage such a knit structure.

The present invention may also be useful in the formation of yams and fabrics with substantial elastomeric content. By way of example, in FIG. 14, there is illustrated a texturized elastomeric yarn 100 including mono filament or a relatively tight bundled core 102 of elastomeric filaments such as SPANDEX® or the like with a texturized effect yarn 104 with full circumferential filament breakage disposed around the core 102. It is believed that the practices of the present invention may be particularly useful in applying such full circumferential filament breakage around the core 102 due to the very limited stress placed on the yarn during filament breakage. That is, the in-line arrangement of the filament breaker and limited self-relieving contact between the yarn and the abrasive surface of the filament breaker during processing serve to prevent excessive elongation in the yarn despite the high elastomeric content of the yarn 100. Moreover, once the yarn 100 is placed into a fabric 106 (FIG. 15), the full circumferential arrangement of the projecting broken fibers provides enhanced surface character without the need for further surface treatments.

The invention may be further understood through reference to the following non-limiting examples.

EXAMPLE 1

A2/150/68 air-jet polyester continuous filament polyester yarn was subjected to circumferential filament breakage in a diamond coated rotating sleeve having an internal diameter of 4 millimeters and operated at 30,000 rpm. The speed of the yarn passing through the rotating sleeve was approximately 600 meters per minute. Prior to processing, the yarn had no measurable occurrence of broken filaments. After processing the yarn was measured to have a number of broken filaments including an average of 24.6 broken filaments per meter having a length greater than 2 millimeters. Measurement of broken filament occurrence and length was performed using a Zweigle G 566 tester.

EXAMPLE 2

Example 1 was repeated in all respects except that the yarn was a 7 ply core and effect air-jet entangled yam. The core was a 3 ply 270 denier construction with 96 filaments per ply and the effect was a 4 ply 245 denier construction with 48 filaments per ply. Prior to processing, the yarn had no measurable occurrence of broken filaments. After processing, the yarn was measured to have a number of broken filaments including an average of over 300 broken filaments per meter having a length greater than 2 millimeters. Measurement of broken filament occurrence and length was performed using a Zweigle G 566 tester.

COMPARATIVE EXAMPLE 1

The yarn of example 1 was treated by the apparatus illustrated and described in U.S. Pat. No. 6,012,206. Prior to processing, the yarn had no measurable occurrence of broken filaments. After processing, the yarn was measured to have a number of broken filaments disposed along the length including an average of 8.3 broken filaments per meter having a length greater than 2 millimeters. Measurement of broken filament occurrence and length was performed using a Zweigle G 566 tester.

COMPARATIVE EXAMPLE 2

The occurrence of protruding surface filaments was measured on a 12 single spun yarn using a Zweigle G 566 tester. The spun yarn was measured to have an average of 71.5 broken filaments per meter having a length greater than 2 millimeters.

It is to be understood that while the present invention has been illustrated and described in relation to potentially preferred embodiments, constructions, and procedures, that such embodiments, constructions, and procedures are illustrative only and that the present invention is in no event to be limited thereto. Rather, it is contemplated that modifications and variations embodying the principles of the present invention will no doubt occur to those of skill in the art. It is therefore contemplated and intended that the present invention shall extend to all such modifications and variations as may incorporate the broad principles of the invention within the full spirit and scope thereof.

That which is claimed is:

1. A process for forming a continuous filament yarn having the surface tactile character of a spun yarn, the process comprising:

passing a cohesive yarn structure of elongate continuous filaments through the interior of a rotating sleeve member disposed in surrounding relation to the cohesive yarn structure, wherein the rotating sleeve member comprises an abrasive inner surface of diameter greater than the cohesive yarn structure such that at least a portion of the elongate filaments disposed at an exterior portion of the cohesive yarn structure are broken and such that terminal ends of the broken filaments define an arrangement of outwardly projecting hairs projecting outwardly at discrete locations disposed substantially around the circumference of the cohesive yarn structure.

2. The invention as recited in claim 1, wherein the cohesive yarn structure is an air-jet entangled yarn.

3. The invention as recited in claim 1, wherein the cohesive yarn structure is characterized by a linear density in the range of about 40 denier to about 10,000 denier.

4. The invention as recited in claim 3, wherein the cohesive yarn structure is characterized by a linear density in the range of about 70 to about 350 denier.

5. The invention as recited in claim 3, wherein the cohesive yarn structure is characterized by a linear density in the range of about 400 denier to about 1000 denier.

6. The invention as recited in claim 3, wherein the cohesive yarn structure is characterized by a linear density in the range of about 1500 denier to about 3000 denier.

7. The invention as recited in claim 1, wherein the cohesive yarn structure is a core and effect air jet entangled yarn.

8. The invention as recited in claim 7, wherein the cohesive yarn structure is characterized by a linear density in the range of about 70 denier to about 10,000 denier.

9. The invention as recited in claim 8, wherein the cohesive yarn structure is characterized by a linear density in the range of about 70 to about 350 denier.

10. The invention as recited in claim 8, wherein the cohesive yarn structure is characterized by a linear density in the range of about 400 denier to about 1200 denier.

11. The invention as recited in claim 8, wherein the cohesive yarn structure is characterized by a linear density in the range of about 1500 denier to about 3000 denier.

12. The invention as recited in claim 1, wherein the cohesive yarn structure is a false twist texturized yarn.

13. The invention as recited in claim 12, wherein the cohesive yarn structure is characterized by a linear density in the range of about 40 denier to about 1500 denier.

14. The invention as recited in claim 13, wherein the cohesive yarn structure is characterized by a linear density in the range of about 70 to about 350 denier.

15. The invention as recited in claim 13, wherein the cohesive yarn structure is characterized by a linear density in the range of about 400 denier to about 1000 denier.

16. The invention as recited in claim 1, wherein at least a portion of the plurality of elongate filaments are characterized by a denier per filament rating of not greater than about 0.6 dpf.

17. The invention as recited in claim 1, wherein at least a portion of the plurality of elongate filaments are selected from the group consisting of solution dyed polyester filaments, package dyed polyester filaments, PLA filaments, nylon filaments, polypropylene filaments, meta-aramid filaments and aramid filaments.

18. The invention as recited in claim 1, wherein the rotating sleeve member comprises an elongated cylinder.

19. The invention as recited in claim 18, wherein the elongated cylinder includes an abrasive inner surface of substantially uniform diameter along the length of the elongated cylinder.

20. The invention as recited in claim 19, wherein the abrasive inner surface comprises an abrasive coating extending substantially around the inner surface.

21. The invention as recited in claim 19, wherein the abrasive inner surface comprises an abrasive coating disposed in a discontinuous pattern around at least a portion of the inner surface.

22. The invention as recited in claim 21, wherein the abrasive coating is disposed in the form of elongated segments disposed in spaced relation around the inner surface.

23. The invention as recited in claim 1, wherein the rotating sleeve member comprises an elongated cylinder and wherein the elongated cylinder includes an abrasive inner surface of variable diameter along the length of the elongated cylinder.

24. The invention as recited in claim 23, wherein the abrasive inner surface comprises an abrasive coating extending substantially around the inner surface.

25. The invention as recited in claim 23, wherein the abrasive inner surface comprises an abrasive coating disposed in a discontinuous pattern around at least a portion of the inner surface.

26. The invention as recited in claim 25, wherein the abrasive coating is disposed in the form of elongated segments disposed in spaced relation around the inner surface.

27. The invention as recited in claim 1, wherein the rotating sleeve member comprises an abrasive coated helix.

28. The invention as recited in claim 27, wherein the abrasive coated helix has a substantially uniform internal diameter along its length.

29. The invention as recited in claim 27, wherein the abrasive coated helix has a variable internal diameter along its length.

30. The invention as recited in claim 29, wherein the abrasive coated helix has an internal diameter of converging diverging hourglass geometry.

31. The invention as recited in claim 1, wherein the rotating sleeve member comprises an arrangement of stacked annular discs such that openings within the annular discs cooperatively define a passageway for acceptance of the cohesive yarn structure and such that inner edges of the annular discs surrounding said openings include an abrasive coating, whereby said inner edges cooperatively define the abrasive inner surface of the rotating sleeve member.

32. The invention as recited in claim 31, wherein the abrasive coating is variable along the length of the rotating sleeve member.

33. The invention as recited in claim 1, wherein the ratio of the rotating speed of the abrasive inner surface to the linear velocity of the cohesive yarn structure passing through the rotating sleeve member is in the range of about 0.02 to about 5.

34. The invention as recited in claim 33, wherein the ratio of the rotating speed of the abrasive inner surface to the linear velocity of the cohesive yarn structure passing through the rotating sleeve member is in the range of about 0.2 to about 3.8.

35. The invention as recited in claim 33, wherein the ratio of the rotating speed of the abrasive inner surface to the linear velocity of the cohesive yarn structure passing through the rotating sleeve member is in the range of about 1.

36. A process for forming a continuous filament yarn having the surface tactile character of a spun yarn, the process comprising the steps of:

passing a cohesive yarn structure through the interior of a rotating sleeve member disposed in surrounding relation to the cohesive yarn structure, wherein the rotating sleeve member comprises an abrasive inner surface of diameter greater than the cohesive yarn structure and adapted to intermittently contact the exterior surface of the cohesive yarn structure as the cohesive yarn structure passes through the rotating sleeve member such that at least a portion of the elongate filaments disposed at the exterior surface of the cohesive yarn structure are broken and centrifugally wrapped at least partially around the interior of the cohesive yarn structure such that terminal ends of the broken filaments define an arrangement of outwardly projecting hairs and wherein the outwardly projecting hairs project away from the interior of the cohesive yarn structure at discrete locations disposed substantially around the circumference of the cohesive yarn structure.

37. The invention as recited in claim 36, wherein the ratio of the rotating speed of the abrasive inner surface to the linear velocity of the cohesive yarn structure passing through the rotating sleeve member is in the range of about 0.02 to about 5.

38. The invention as recited in claim 37, wherein the ratio of the rotating speed of the abrasive inner surface to the linear velocity of the cohesive yarn structure passing through the rotating sleeve member is in the range of about 0.2 to about 3.8.

39. The invention as recited in claim 37, wherein the ratio of the rotating speed of the abrasive inner surface to the linear velocity of the cohesive yarn structure passing through the rotating sleeve member is in the range of about 1.

40. An apparatus for texturizing a continuous filament yarn to impart the surface tactile character of a spun yam, the apparatus comprising:

a rotating sleeve member disposed in-line with said continuous filament yarn along a yarn conveyance path, wherein the rotating sleeve member is adapted to surround said continuous filament yarn and wherein the rotating sleeve member comprises an abrasive inner surface of diameter greater than the continuous filament yarn, the abrasive inner surface being adapted to intermittently contact filaments at an exterior surface of the continuous filament yarn as the continuous filament yarn passes through the rotating sleeve member such that at least a portion of the filaments at the exterior surface of the continuous filament yarn are broken and centrifugally wrapped at least partially around an interior portion of the continuous filament yarn and terminal ends of the broken filaments define an arrangement of outwardly projecting hairs projecting away from the interior of the continuous filament yarn at discrete locations disposed substantially around the circumference of the continuous filament yarn.

* * * * *